US007284282B2

(12) United States Patent
Bay

(10) Patent No.: US 7,284,282 B2
(45) **Date of Patent: *Oct. 23, 2007**

(54) HYBRID VENTILATED GARMENT

(75) Inventor: Marc A. Bay, Farmington, MI (US)

(73) Assignee: Robison's Inc., Idaho Falls, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/170,934

(22) Filed: Jun. 29, 2005

(65) Prior Publication Data

US 2005/0235392 A1 Oct. 27, 2005

Related U.S. Application Data

(62) Division of application No. 10/366,625, filed on Feb. 13, 2003, now Pat. No. 7,111,328.

(51) Int. Cl.
*A41D 1/02* (2006.01)

(52) U.S. Cl. ..... 2/93; 2/DIG. 1; 2/85

(58) Field of Classification Search ..... 2/69, 2/108, 94, 93, 102, 85, 97, 115, 96, DIG. 1; 128/874

See application file for complete search history.

(56) References Cited

U.S. PATENT DOCUMENTS

| | | | |
|---|---|---|---|
| 317,711 | A | 5/1885 | Brinkmann |
| 367,921 | A | 8/1887 | Norton |
| 375,504 | A | 12/1887 | Norton |
| 385,306 | A | 6/1888 | Helwitz |
| 1,015,231 | A | 1/1912 | Jacobs |
| 1,121,515 | A | 12/1914 | Lipman |
| 1,250,004 | A | 12/1917 | Philip |
| 1,360,390 | A | 11/1920 | Gilfillan |
| 1,647,656 | A | 11/1927 | Olsen |
| 1,648,282 | A | 11/1927 | Schneider |
| 1,679,102 | A | 7/1928 | Thompson |
| 1,693,464 | A | 11/1928 | Quantz |
| 1,714,491 | A | 5/1929 | Burr |
| 1,782,000 | A | 11/1930 | Collins |
| 1,799,572 | A | 4/1931 | Sweeney |
| 1,971,622 | A | 8/1934 | Quackenbush |
| 1,973,421 | A | 9/1934 | Wallace |

(Continued)

FOREIGN PATENT DOCUMENTS

BE 494309 3/1950

(Continued)

OTHER PUBLICATIONS

2001 Kushitani Riding Equipment Collection, 2001,9 pages.

(Continued)

*Primary Examiner*—Alissa Hoey
(74) *Attorney, Agent, or Firm*—Harness, Dickey & Pierce, P.L.C.

(57) ABSTRACT

A hybrid, ventilated garment is provided. Another aspect of the present invention employs a jacket having a body portion with sleeves and a torso, and a removable shell portion having sleeve and torso segments. A further aspect of the present invention provides wind resistant shoulder and sleeve segments which are permanently attached together, and an air permeable and/or perforated lower torso segment attached to at least the shoulder segment.

32 Claims, 8 Drawing Sheets

U.S. PATENT DOCUMENTS 2,010,434 A 8/1935 Langrock
2,073,711 A 3/1937 Robinsohn
2,079,980 A 5/1937 Anders
2,084,173 A 6/1937 Wexler
2,100,991 A * 11/1937 Watson ..... 2/85
2,114,514 A 4/1938 York
D115,983 S 8/1939 Bailey
D119,122 S 2/1940 Bauer
2,186,918 A 9/1940 Wolf
2,259,560 A 10/1941 Glidden
2,391,535 A 12/1945 Zelano
2,458,004 A 1/1949 Kerr
2,469,700 A 5/1949 Petrucelli
D160,800 S 11/1950 Mandelbaum
2,585,840 A 2/1952 Reynolds
2,644,946 A 7/1953 Menz et al.
2,700,769 A 2/1955 Polchinski
2,713,168 A 7/1955 Bagnato
2,715,226 A 8/1955 Weiner
2,722,694 A 11/1955 Bryant
2,989,764 A 6/1961 Bukspan
3,045,243 A 7/1962 Lash et al.
3,086,215 A 4/1963 Di Paola
3,153,793 A 10/1964 Lepore
3,213,465 A 10/1965 Ludwikowski
3,389,407 A 6/1968 Morrison
3,536,083 A 10/1970 Reynolds
D220,822 S 5/1971 DeWan
3,638,241 A 2/1972 Holmes
3,691,564 A 9/1972 LaMarre et al.
3,706,102 A 12/1972 Grenier
3,731,319 A * 5/1973 O'Neill ..... 2/2.17
3,761,962 A 10/1973 Myers
3,771,169 A 11/1973 Edmund
3,921,224 A 11/1975 Ingram, III
3,924,273 A 12/1975 Donovan
3,969,772 A 7/1976 Pravaz
D248,896 S 8/1978 Hasday et al.
4,122,553 A 10/1978 Pitkanen
4,170,793 A 10/1979 O'Brein
4,185,327 A 1/1980 Markve
4,195,362 A 4/1980 Rolando
D261,071 S 10/1981 Rolando
4,390,996 A 7/1983 Read
4,397,043 A 8/1983 Croteau
4,408,356 A 10/1983 Abrams
4,513,451 A 4/1985 Brown
4,554,682 A 11/1985 Hillquist
4,563,777 A 1/1986 Park
4,569,089 A 2/1986 Nesse
4,608,715 A 9/1986 Miller et al.
4,665,563 A 5/1987 Harvey
4,722,099 A 2/1988 Kratz
4,783,858 A 11/1988 Chevalier
D306,511 S 3/1990 Jones
D308,435 S 6/1990 Kushitani
D310,286 S 9/1990 Kushitani
4,996,723 A 3/1991 Huhn et al.
5,033,118 A 7/1991 Lincoln
5,097,535 A 3/1992 Dye et al.
5,105,477 A 4/1992 Golde
5,105,478 A 4/1992 Pye
5,115,516 A 5/1992 Golde
D332,342 S 1/1993 Dye et al.
5,189,737 A 3/1993 Ribicic
5,201,075 A 4/1993 Svetich
5,325,537 A 7/1994 Marion
5,398,343 A 3/1995 Kuracina
5,507,042 A 4/1996 van der Slessen
5,555,562 A 9/1996 Holt et al.
5,592,691 A 1/1997 Ronald
5,603,646 A 2/1997 Tobias
5,685,015 A 11/1997 Aldridge
5,687,423 A 11/1997 Ross
D387,190 S 12/1997 Garcia
5,704,064 A 1/1998 van der Sleesen
5,718,000 A 2/1998 Ost et al.
5,752,277 A 5/1998 van der Sleesen
5,774,891 A 7/1998 Boyer
5,845,336 A 12/1998 Golde
5,850,634 A 12/1998 Toombs
5,852,828 A * 12/1998 Foster ..... 2/102
5,864,888 A * 2/1999 Archer ..... 2/227
5,884,332 A 3/1999 Snedeker
5,918,310 A * 7/1999 Farahany ..... 2/23
5,924,135 A 7/1999 Worth
5,933,865 A 8/1999 Aldridge
6,018,819 A 2/2000 King et al.
D426,050 S 6/2000 Bowen
6,070,274 A 6/2000 van der Sleesen
6,085,353 A * 7/2000 van der Sleesen ..... 2/69
6,119,270 A 9/2000 Chou
6,161,223 A * 12/2000 Andrews ..... 2/234
6,163,883 A 12/2000 Hong
D437,673 S 2/2001 DesJardins et al.
D438,692 S 3/2001 Digby
6,260,196 B1 7/2001 van der Sleesen
6,260,200 B1 * 7/2001 Alfred ..... 2/69
6,263,509 B1 7/2001 Bowen
6,263,510 B1 * 7/2001 Bay et al. ..... 2/93
6,263,511 B1 7/2001 Moretti
6,295,654 B1 10/2001 Farrell
6,298,485 B1 10/2001 Heller
6,339,843 B1 1/2002 Grilliot et al.
6,339,845 B1 1/2002 Burns et al.
6,360,371 B1 3/2002 Davey
6,405,377 B1 6/2002 Davis
6,421,834 B2 7/2002 Kester
6,460,185 B1 10/2002 Hardy
6,490,734 B2 12/2002 Blauer et al.
6,499,141 B1 12/2002 Egnew
D474,323 S 5/2003 Carter
D479,901 S 9/2003 Brownlee
D479,902 S 9/2003 Brown
6,675,389 B1 * 1/2004 Kublick ..... 2/2.17
6,684,408 B2 2/2004 Rindle et al.
6,792,621 B2 9/2004 Braun
6,802,082 B2 10/2004 Watley
D498,037 S 11/2004 Bay
6,851,128 B1 2/2005 Parrotte
6,854,130 B2 2/2005 van der Sleesen
6,868,557 B1 3/2005 van der Sleesen
D517,281 S 3/2006 Tanner et al.
7,017,191 B2 3/2006 Golde
D526,465 S 8/2006 Rindle
D526,469 S 8/2006 Collier
D529,687 S 10/2006 Rindle
7,171,695 B2 2/2007 Braun
7,181,774 B2 2/2007 Silver
2003/0013368 A1 1/2003 Braun
2003/0033656 A1 2/2003 Jaeger
2003/0079271 A1 * 5/2003 Gillen et al. ..... 2/102
2003/0172435 A1 * 9/2003 Rindle et al. ..... 2/108
2004/0055069 A1 3/2004 Fayle et al.
2005/0015843 A1 1/2005 Roux et al.
2005/0066406 A1 3/2005 Sleesen
2006/0041990 A1 3/2006 Alesina et al.
2006/0277653 A1 12/2006 Okajima

FOREIGN PATENT DOCUMENTS

CA 1056553 6/1979
CA 2 344 726 10/2002
DE 517523 1/1931

| | | |
|---|---|---|
| EP | 0 000 095 | 12/1978 |
| EP | 0 034 518 | 1/1981 |
| EP | 0 071 226 | 2/1983 |
| EP | 0 643 929 | 3/1985 |
| EP | 0 161 564 | 11/1985 |
| EP | 0 412 450 | 2/1991 |
| EP | 0 819 389 | 1/1998 |
| EP | 0 870 745 | 10/1998 |
| EP | 0 913 170 | 6/1999 |
| EP | 0 974 277 | 1/2000 |
| EP | 1 329 167 A2 | 7/2003 |
| FR | 1029.851 | 3/1953 |
| FR | 1.220.511 | 1/1960 |
| FR | 2.094.362 | 1/1972 |
| FR | 2 127 140 | 9/1972 |
| FR | 2 413 052 | 12/1977 |
| FR | 2 460 634 | 7/1979 |
| FR | 2 546 759 | 12/1984 |
| FR | 2 783 138 | 3/2000 |
| GB | 461247 | 2/1937 |
| GB | 2 104 770 A | 3/1983 |
| JP | 48-12006 | 2/1973 |
| JP | 49-9409 | 1/1974 |
| JP | 50-11703 | 2/1975 |
| JP | 53-155409 | 12/1978 |
| JP | 55-176314 | 12/1980 |
| JP | 56-15732 | 2/1981 |
| JP | 57-147212 | 9/1982 |
| JP | 58-105410 | 7/1983 |
| JP | 59-4722 | 1/1984 |
| JP | 61-94510 | 6/1986 |
| JP | 7-2417 | 1/1995 |
| JP | 8-284009 | 10/1996 |
| WO | WO 94/00036 | 1/1994 |
| WO | WO 96/39056 | 12/1996 |
| WO | WO 02/01977 | 1/2002 |
| WO | WO 02/060287 | 8/2002 |
| WO | WO 03/006234 | 1/2003 |

OTHER PUBLICATIONS

Cabela's Master Catalog, Fall 1998, p. 50-51.
Red Head, Fall 1999, Specialist Catalog, p. 17.
AGV Aeromesh Textile Jacket, www.agvsport.com (2004).
Fieldsheer Mach 1, Mach 2, Sonic Air, Titanium Air, Highland Suit, Highland 2, Kiri, Manx Pro, Spiga, Thistle, XPack Tech, Cabrio, Latrak jackets; http://store.fieldsheer.com (Feb. 8, 2003).
Japanese publication with English translation entitled "Proto War-RJ" citing Kiss Racing, (believed to have been published in 2000).
European Search Report for EP 03 29 1709, 2 pages.
Five photographs of Joe Rocket® "Bulldog" jacket (offered for sale before 2003).
"Fieldsheer Air Speed Jacket", Advertisement from Parts & Accessories, Motorcycleville.com, Year 2001 Model, (published Feb. 8, 2003) 1 page.
"Joe Rocket" Catalog, Spring 2002, (published 2002), Cover page and pp. 4-5, 13, 32 and 35.
"Steve Largent Autographed Football Jersey Mesh", Advertisement from Collectibles.goantiques,com, 1996-2003, (published Feb. 8, 2003), 1 page.
Drawing of Fieldsheer Jacket with removable torso vest (offered for sale or publicly used prior to Feb. 13, 2003), 1 page.
2000 Motorcycle—Joe Rocket brochure, back page and p. 5 ("Bulldog" jacket), published in 1999.
"Fieldsheere" Advertisement from fieldsheeronline.com, 3 pages (2003).
Cabela's 1994 Fall, Catalog; p. 71, "Columbia Gizzmo Parka".

* cited by examiner

HYBRID VENTILATED GARMENT

CROSS REFERENCE TO RELATED APPLICATION

This application is a divisional of U.S. patent application Ser. No. 10/366,625, filed Feb. 13, 2003 now U.S. Pat. No. 7,111,328. The disclosure of the above application is incorporated by reference herein.

BACKGROUND OF THE INVENTION

The present invention relates generally to a garment and more particularly to a hybrid ventilated garment.

Garments, such as jackets and combined pant/jacket racing suits, are commonly used by people operating motor sport vehicles such as a motorcycle, all-terrain vehicle or snowmobile. Such jackets and suits commonly employ an outer shell covering the complete torso and arms of the person, and an inner insulative liner which can be removed for warm weather use. For example, reference should be made to U.S. Pat. No. 6,263,510 entitled "Ventilating Garment" which issued to Bay et al. on Jul. 24, 2001. This patent is incorporated by reference herein.

Another conventional motorcycle jacket employed a leather torso have perforations on the shoulder, chest, back and lower torso regions. It also had solid and non-perforated sleeves sewn to the torso. A non-perforated and wind resistant vest was optionally provided to externally cover the perforated torso of the jacket but could be removed to allow air entry through the torso holes. A first vertical zipper was provided for the front of the jacket torso and a second front vertical zipper was provided for the vest. This conventional jacket, however, suffered from the disadvantages of allowing undesired air flow through the sleeve-to-torso openings between the vest and jacket interface, ultraviolet light penetrating through the perforated shoulders of the torso when the vest was removed thereby leading to sunburn of the wearer, crash protection not being provided at the shoulders of the jacket when the vest was removed, and the two-piece appearance of the vest and jacket being unattractive.

SUMMARY OF THE INVENTION

In accordance with the present invention, a hybrid, ventilated garment is provided. Another aspect of the present invention employs a jacket having a body portion with sleeves and a torso, and a removable shell portion having sleeve and torso segments. A further aspect of the present invention provides wind resistant shoulder and sleeve segments which are permanently attached together, and an air permeable and/or perforated lower torso segment attached to at least the shoulder segment. In still another aspect of the present invention, an air permeable and/or perforated sleeve section is attached to an ultraviolet light blocking upper sleeve section and a dense weave shell is removably attachable to cover the air permeable sleeve section. In a further aspect of the present invention, a flap operably covers a supplemental and diagonal zipper without covering a main front and generally vertical zipper.

The present invention garment is advantageous over traditional jackets in that the present invention always provides ultraviolet light blockage along the wearer's shoulders and upper arm portions. The present invention is further advantageous by providing crash protective pads and/or body armor, at least some of which are preformed, even if an outer torso shell is removed. Moreover, the present invention is advantageous by allowing significant torso and sleeve ventilation for use in hot weather yet easily allows attachment of a wind resistant, and/or thermally insulating and/or waterproof portion to cover the underlying air permeable and/or perforated material. The present invention is also aesthetically fashionable and provides easy to use attachment systems which effectively reduce air entry holes when the ventilating material is covered. Additional advantages and features of the present invention will become apparent from the following description and appended claims, taken in conjunction with the accompanying drawings.

DETAILED DESCRIPTION OF THE PREFERRED EMBODIMENT

Figure 1:
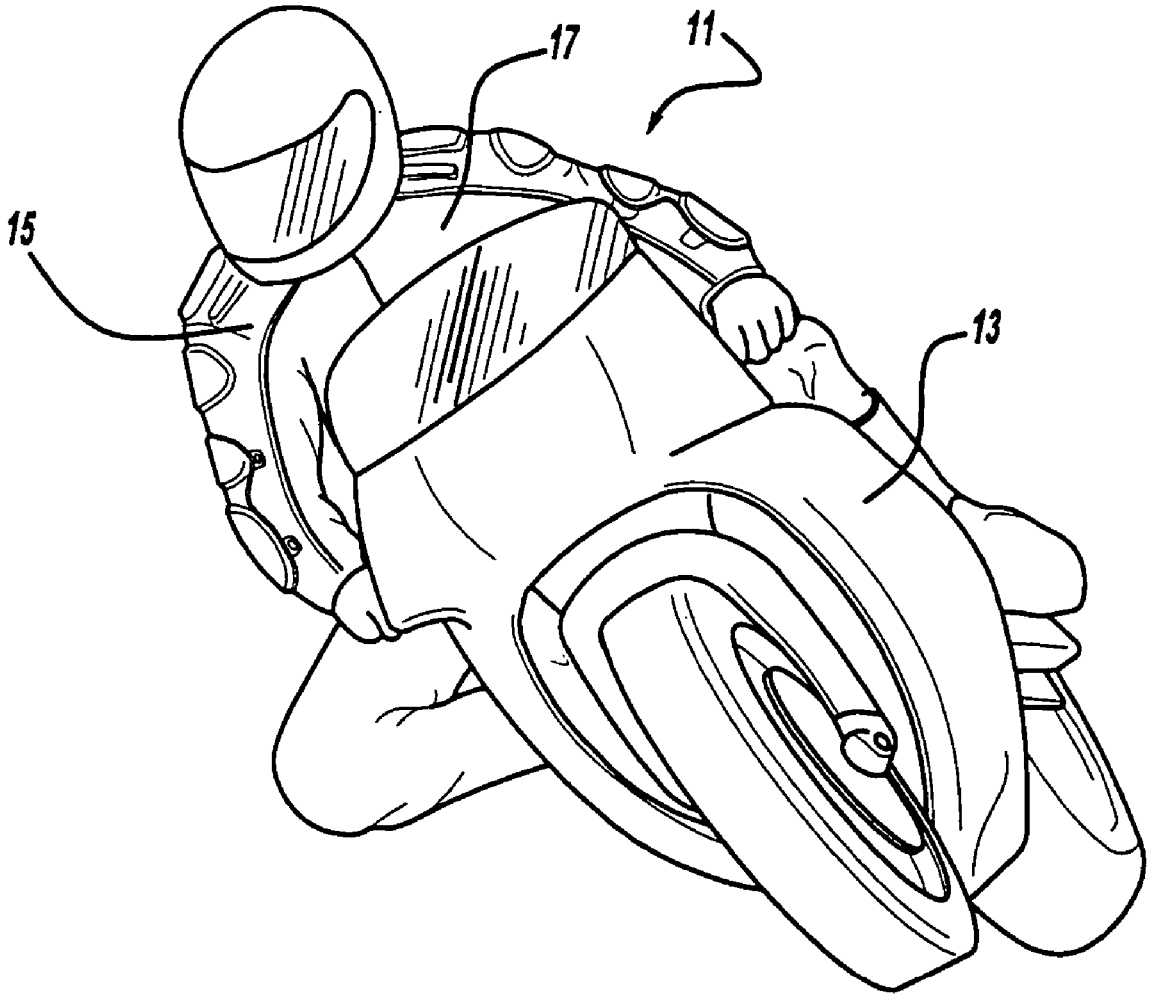
FIG. 1 is a perspective view showing the preferred embodiment of the hybrid ventilated garment of the present invention, used by a rider on a motorcycle.

Referring to FIGS. 1-3 and 8, the preferred embodiment of a hybrid ventilated garment, preferably a jacket 11 or a jacket portion of a combined jacket/pant racing suit, of the present invention is worn by a person riding a motorcycle 13 or other motorized vehicle such as an all-terrain vehicle or snowmobile. Hybrid jacket 11 includes two major portions, a body 15 and a shell 17. Body 15 has a mesh inner liner 24, an outer wind resistant material 25 and an outer mesh material 63.

Crash absorbing padding, also known as body armor, are positioned as follows. A pair of preformed, convex shoulder pads 19 are internally attached within pockets sewn to mesh inner liner 24. These pockets are closed at their top edges by hook and loop-type fasteners. Furthermore, preformed elbow pads 21 are inserted into internal pockets sewn to an inside of liner 24 and the elbow pockets are closed at their bottom edges by hook and loop-type fasteners. Three predominantly flat shoulder pads 23 are directly sewn to an inside surface of wind resistant material 25 located at each side of shoulder segment 27 of body 15. A mesh intermediate layer (not shown), locally sewn to the inside of wind resistant material 25 of each side of shoulder segment 27, assists in retaining shoulder pads 23 to material 25. A predominantly flat upper arm pad 29 is also sewn to the inside surface of the wind resistant material, with an additional and localized intermediate mesh, at each sleeve segment 31 of body 15 adjacent a sleeve-to-torso sewn seam 33. A generally flat upper back pad 35 is similarly sewn to an inside of wind resistant material 25 and secured by another localized, intermediate mesh material. Furthermore, a preformed, waffle-patterned, spine pad 37 is removably located in a pocket sewn within liner 24 having a horizontal hook and loop attachment and opening across a middle of the pocket. A generally flat, lower back pad 39 is sewn to the inside of a waistband segment 41, also made of wind resistant material 25. Finally, a pair of flat intermediate, back pads 79 and 81 are sewn to an inside surface of outer mesh fabric 63. The generally flat pads are more flexible than are the preformed ones and they are preferably made of a foam-like material. The preformed pads are preferably molded from multi-layer composite, resinated foam-like materials. Some of the body armor pieces disclosed herein, which aid in cushioning the impact the motorcycle user receives during motorcycle crashes, can be readily substituted or supplemented by rigid polymeric panels having flat or three-dimensionally curved shapes.

A pair of sleeve diameter adjustments 41*a* are located on each sleeve 31 adjacent the elbow area. Each sleeve adjustment includes a fabric tab 43 upon which is mounted a female snap attachment 45. A pair of spaced apart, male snap attachments 47 protrude from the sleeve for selective attachment with female snap attachment 45. Moreover, a cuff adjustment 51 is disposed adjacent a distal open end 53 of each sleeve which corresponds to a wrist area of the user. Each cuff adjustment 51 includes a zipper assembly 55 with a flexible piece of triangularly-shaped fabric sewn between the zipper tracks and which can be expanded when the zipper 55 is unzipped or hidden from view when zipped. The positioning of cuff adjustments 51 and the body armor is highly advantageous by allowing same to be worn by the motorcycle rider regardless of whether hybrid jacket 11 is in its fully closed, wind blocking mode or in its fully ventilated mode with shell 17 removed from body 15 as will be discussed in greater detail hereinafter.

Referring now to FIGS. 6-9, a lower torso segment 61, herein defined as the entire front, back and side areas of the jacket body between shoulder segment 27 and waistband 41, is made from outer mesh fabric material 63 and perforated liner 24 which are air permeable for two-way ventilation. A front central and vertically elongated zipper attachment system 65 is disposed on the front of torso segment 61 and includes a pair of parallel zipper tracks with teeth and a zipper pull slide. Outer mesh material 63 laterally extends around the entire torso from zipper track to zipper track of central zipper system 65 and is interrupted by front piping welts 67 and zipped pocket openings 69 sewn thereto. Outer mesh material 63 is further located on the lower areas of each sleeve 31 extending from distal end 53 to armpit seam 33. Thus, outer mesh material 63 is permanently sewn to wind resistant material 25 along the entire front and rear sleeve segments 31 and shoulder segment 27 with a piping welt 71, supplemental frontal zipper attachment systems 73 and a continuous rear zipper attachment system 75*a* therebetween. Each zipper system includes a pair of toothed zipper tracks and a zipper pull slide. In other words, rear zipper attachment system 75*a* extends from one sleeve distal end 53, horizontally across the back of the torso and to the opposite sleeve distal end 53. Inner liner 24 is sewn essentially within the entire body 15 of jacket 11 between internally folded cuffs at distal ends 53 of the sleeves, and between waistband 41 and an upper collar 75, except at wind resistant storm flaps 76 extending inwardly by between 60-100 millimeters from the zipper tracks associated with central zipper system 65. An optional pant zipper attachment 77 is horizontally sewn across an inside surface of inner liner 24 at a back of the torso segment between spine pad 37 and waistband 41.

Outer mesh material 63 is preferably a knitted, polypropylene fabric having perforated holes of approximately 3 millimeters high at dimension "a" by approximately 2 millimeters wide at dimension "b" (see FIG. 9); one such fabric can be obtained from Geo Change Fabric Co. stock number GCN-7151, SH-Mesh. Inner liner 24 is preferably a lighter weight, polyester knitted fabric having perforated holes of approximately the same size as for the outer mesh material but offset therefrom when sewn into the garment. The much denser wind resistant and ultraviolet light blocking material 25 located on body 15 and shell 17 are preferably a 600 denier polyester fabric having a polyurethane inside coating, but may alternately be Taslen or Cordura® brand nylon fabric.

Waistband 41 includes a pair of elastic sections 81 with vertical stitches between each fold and an inner elastic strip which laterally contracts. A waist attachment system 83 is also provided at each forward side of waistband 41. Each waist attachment system 83 includes a fabric flap sewn adjacent elastic section 81 with a female snap attachment secured thereto. Three horizontally spaced male attachments protrude from a laterally outboard section of waistband 41 for selective fastening to the female snap attachment.

Collar 75 includes an outer layer made of wind resistant material 25 and an attached inner layer lined with a fleece-like material. A female snap attachment 85 is secured to a protruding front end of collar 75 while selectively matable and spaced apart male attachment fasteners 87 are secured to the opposite end of collar 75 to allow variable diameter neck closure.

Figure 2:
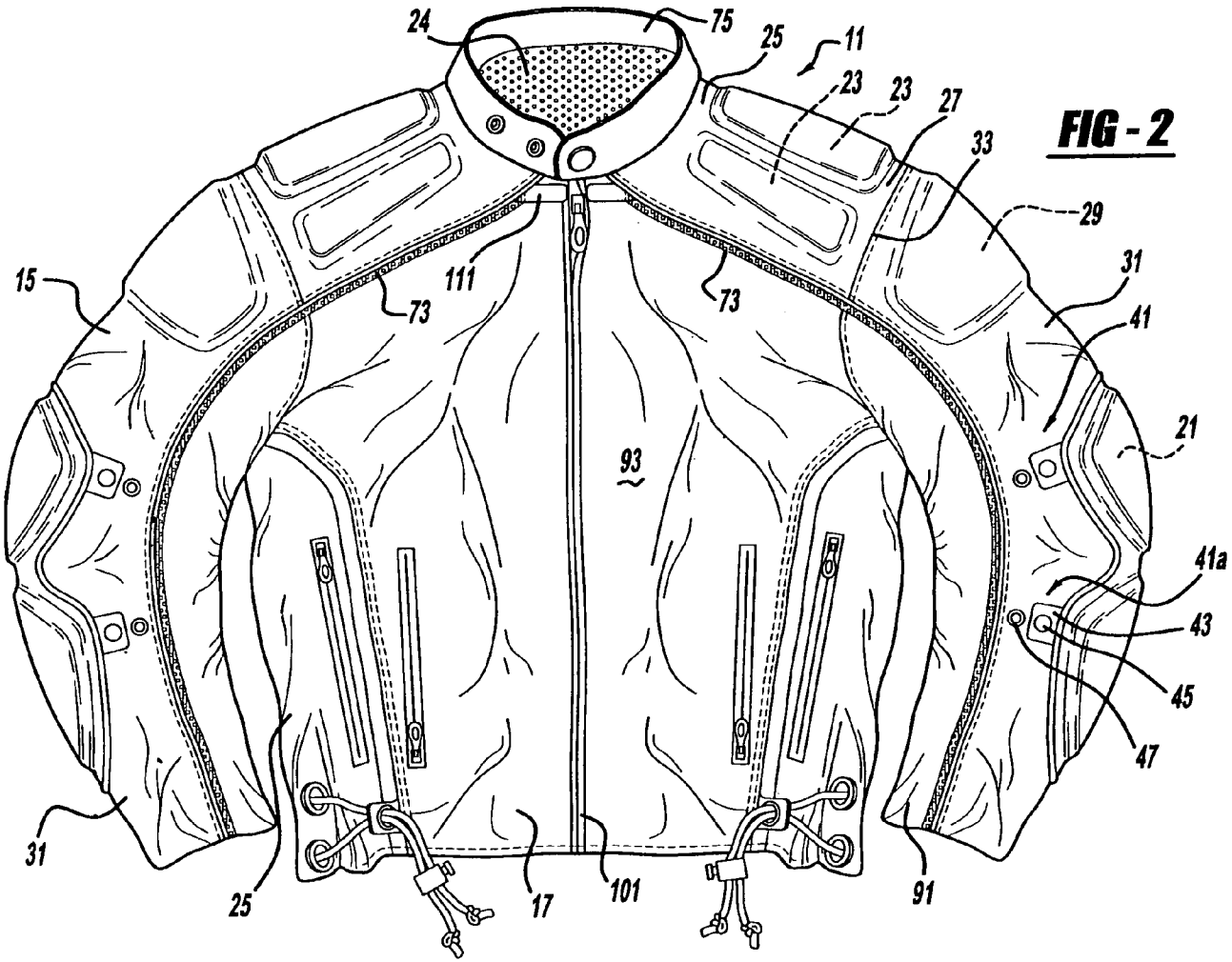
FIG. 2 is a front elevational view showing the preferred embodiment garment, with a shell attached to a body.
Figure 3:
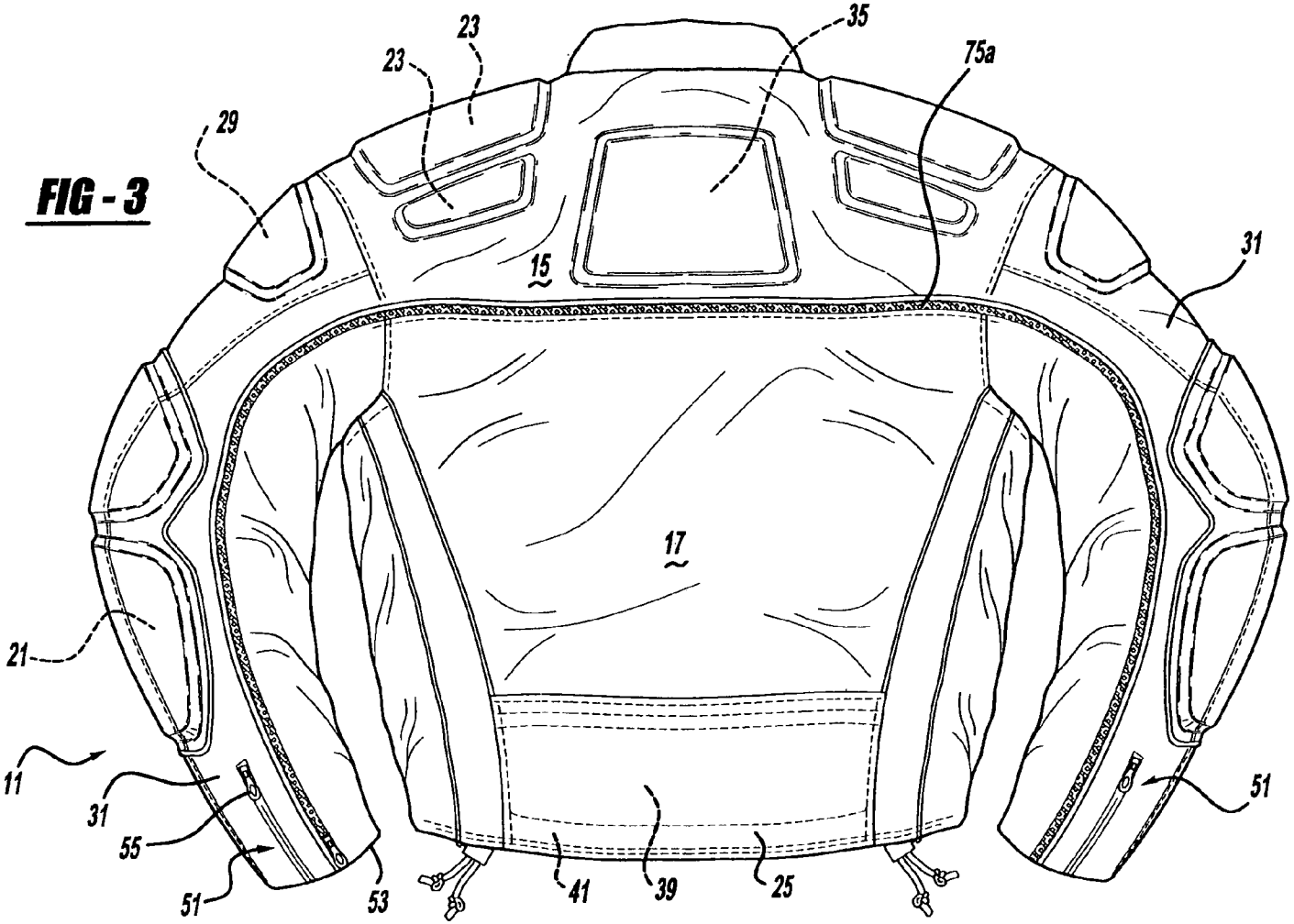
FIG. 3 is a rear elevational view showing the preferred embodiment garment, with the shell attached to the body.
Figure 8:
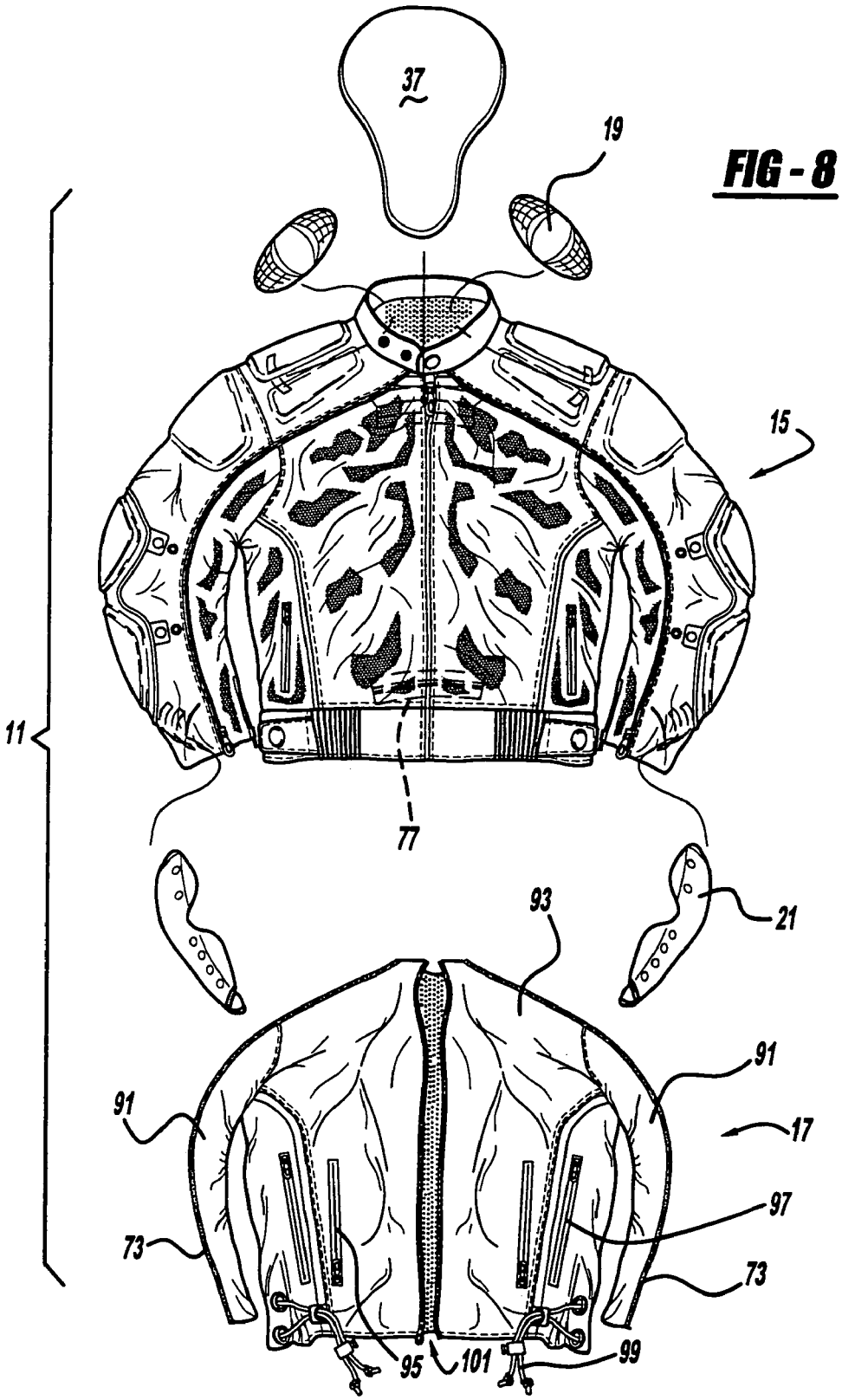
FIG. 8 is a partially exploded, front elevational view showing the preferred embodiment garment.
Figure 9:
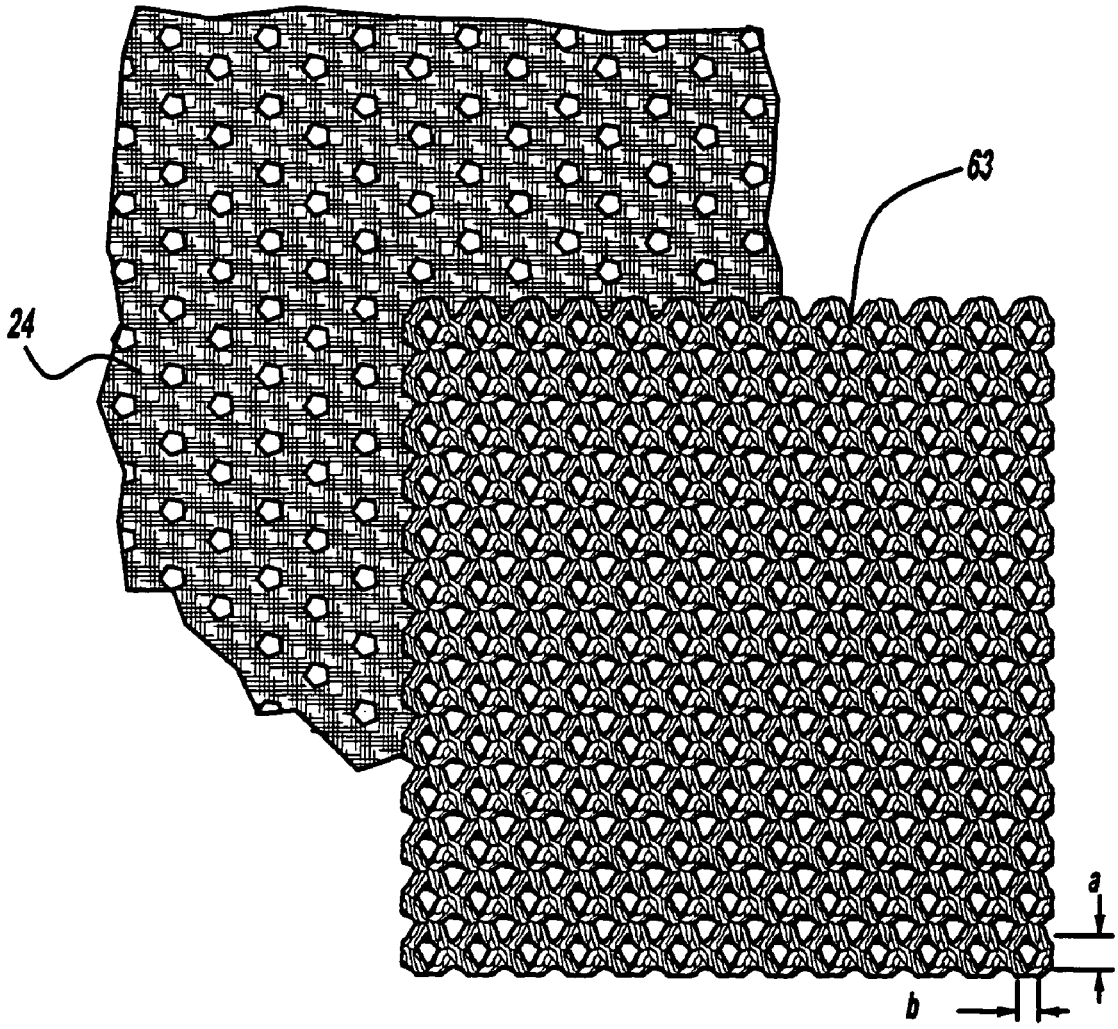
FIG. 9 is an enlarged and fragmentary, front elevational view, taken with circle 9 of FIG. 6, showing the air permeable mesh employed in the preferred embodiment jacket.

Shell 17 can best be observed in FIGS. 2, 3 and 8. Shell 17 includes left and right sleeve halves 91 which are permanently sewn to a lower torso segment 93. Shell 17 includes an outer fabric layer 121 made from the wind resistant material and an inner fabric layer 123 made of the perforated liner material like the body. One each zipper track of supplemental zipper attachment systems 73 and 75*a* are sewn to an upper edge of sleeve half segments 91 and continue along upper edges of lower torso segment 93. This allows for sleeve half segments 91 and the upper edges of torso segment 93 to be removably zipped onto sleeve segments 31 and shoulder segments 27 of body 15 at the front and rear of the jacket. Left and right front torso zippers 95 are provided in shell 17 to allow access to pockets sewn into the shell. A pair of torso side zippers 97 are openable to allow access to corresponding pocket zippers 69 within body 15 and/or to provide localized venting into jacket 11 even when shell 17 is secured to body 15. A pair of elasticized pull cords 99, externally held together at each end by a compressible polymeric toggle and fabric tab, enter eyelets on each side of shell 17 and extend between the outer fabric layer and the inner fabric layer. These cords are used to tighten the lateral periphery of shell 17 in use to minimize air entry. A main zipper attachment system 101 vertically extends along a front torso centerline.

Figure 4:
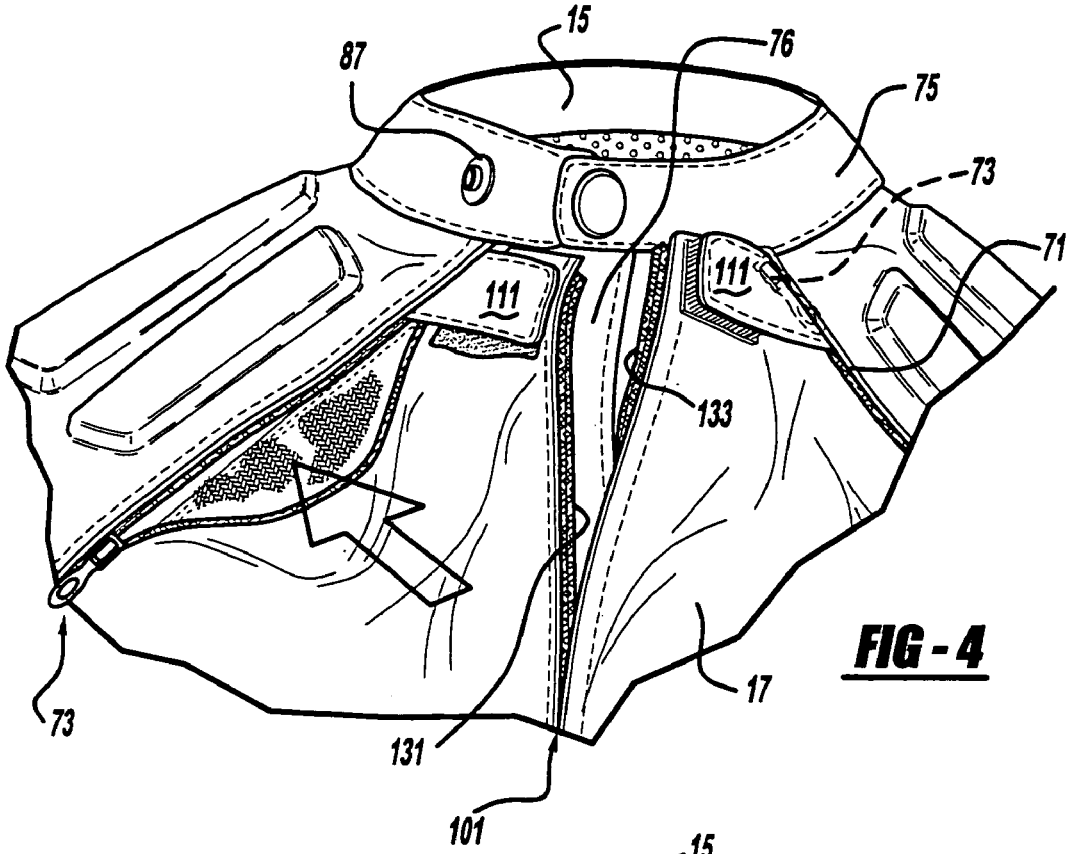
FIG. 4 is an enlarged front elevational view showing shell attachment systems in a first positional arrangement employed with the preferred embodiment garment.
Figure 5:
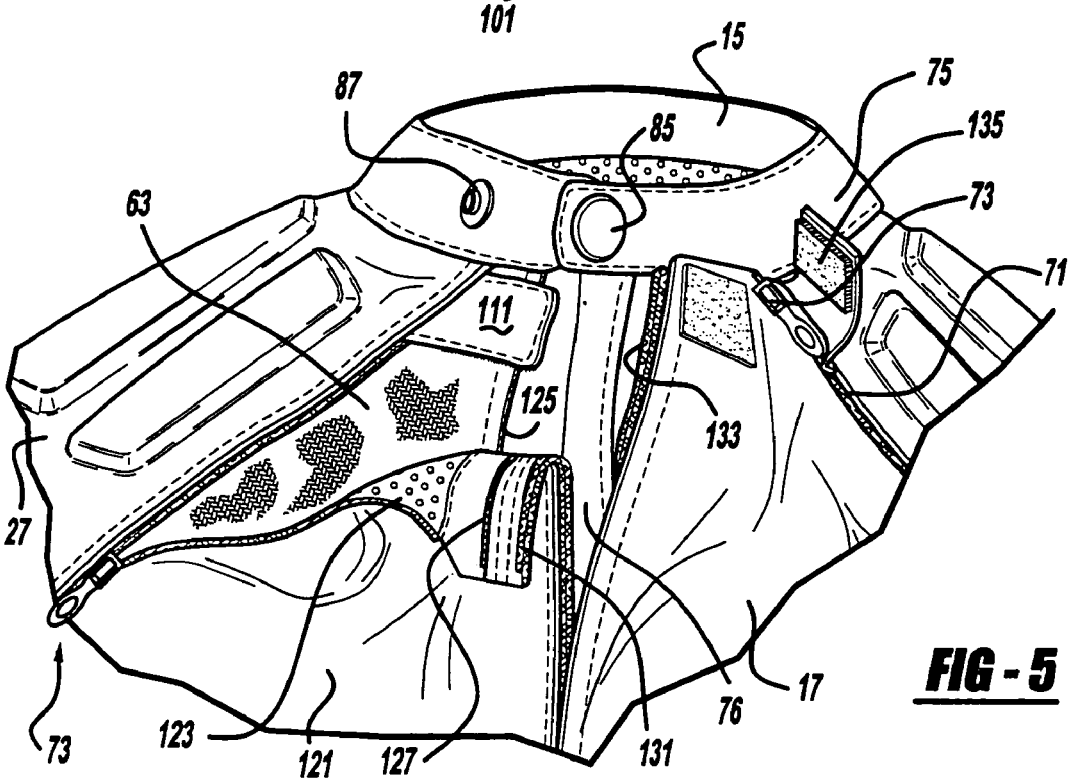
FIG. 5 is an enlarged front elevational view showing shell-to-body attachment systems in a second positional arrangement employed with the preferred embodiment garment.
Figure 6:
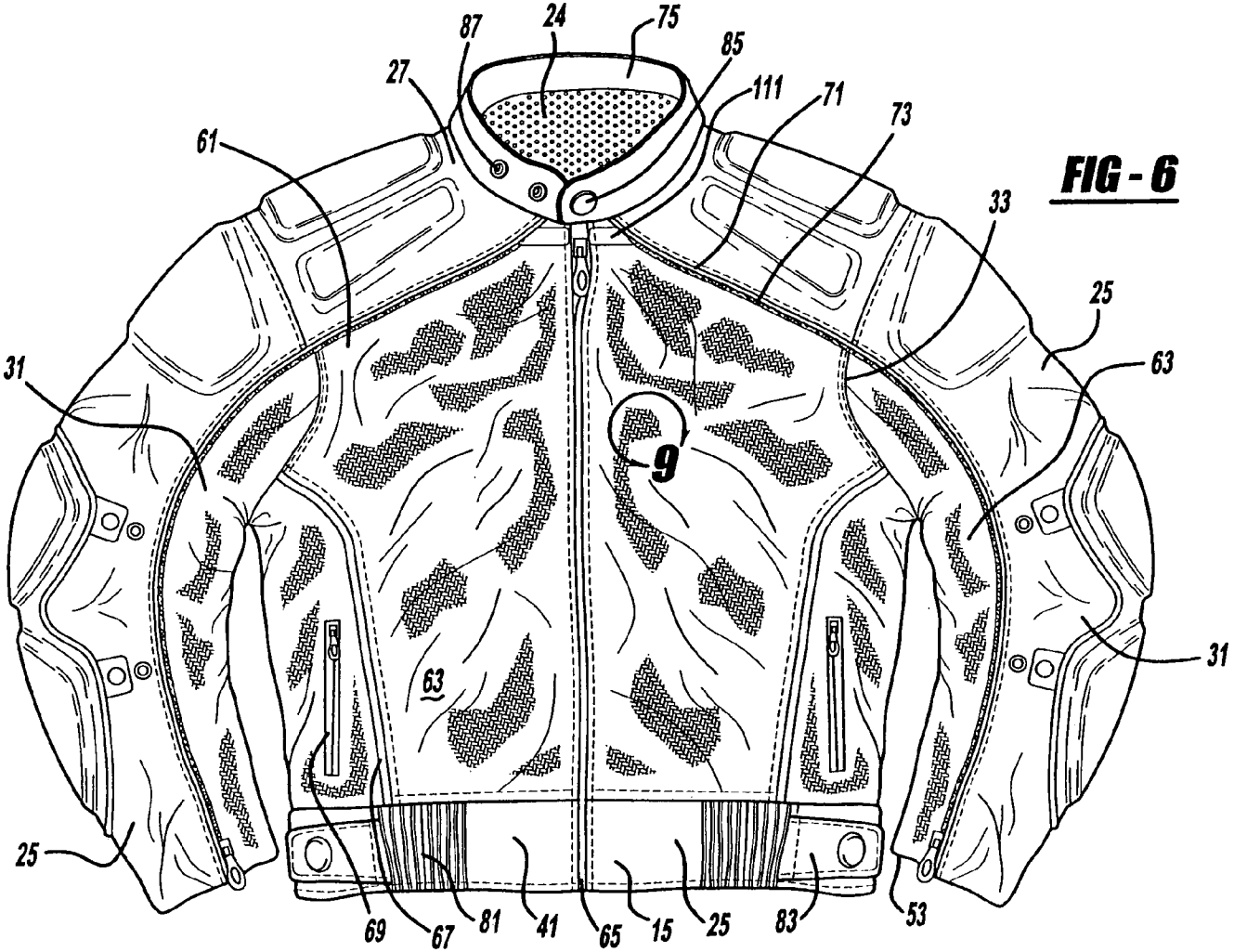
FIG. 6 is a front elevational view showing the preferred embodiment garment, with the shell removed.
Figure 7:
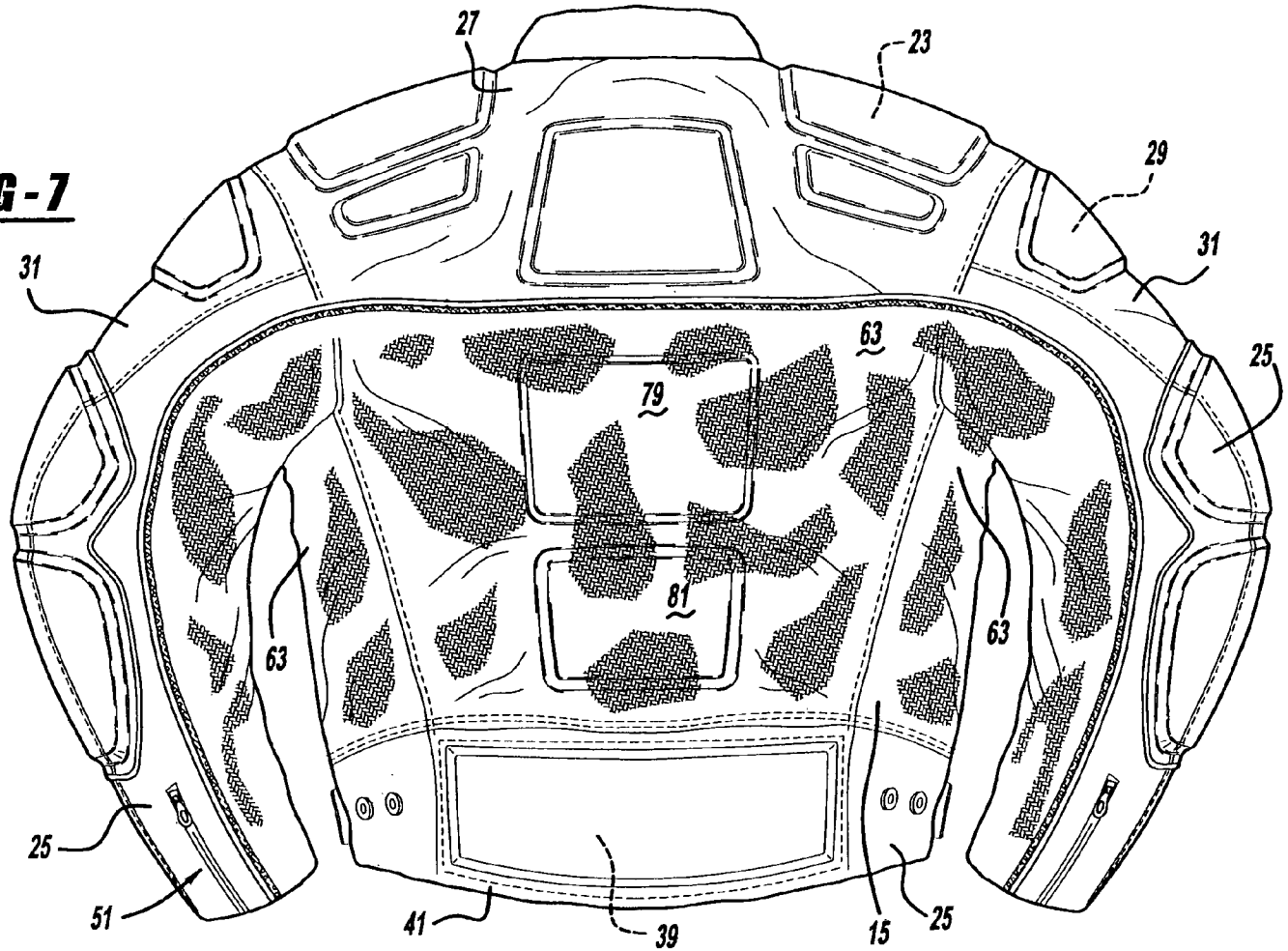
FIG. 7 is a rear elevational view showing the preferred embodiment garment, with the shell removed.

As can best be observed in FIGS. 2, 4-6 and 8, the front zipper scheme is as follows. When shell 17 is removed from body 15, the front centerline torso is closed by zipper system 65 as shown in FIG. 6. When shell 17 is attached to body 15, however, an inwardly projecting zipper track 125 of main zipper system 65 engages with an outwardly projecting zipper track 127 which has a zipper pull slide, of shell's main zipper system 101, for each side of the central opening.

Furthermore, when in the attached shell-to-body condition, the inwardly projecting zipper tracks 131 and 133 of main zipper system 101 engage each other to serve as the sole front closure between the left and right front torso sections for both shell 17 and body 15. This allows for very easy, single zipper use of the jacket when the user wishes to secure or unsecure the front. Additionally, when shell 17 is attached to body 15, flaps 111 are positioned to cover the upper ends of front supplemental zipper systems 73 to deter wind and cold from entering between the upper edge of shell 17 and collar 75. More specifically, a proximal end of each flap 111 is sewn to shoulder segment 27 adjacent piping welt 71. Flap 111 is made of a flexible fabric material and has one portion of a hook and loop-type fastener attachment 135 on an inside thereof for mating with the opposite side of the hook and loop-type fastener attachment sewn onto shell 17. Thus, each flap 111 extends across the underlying supplemental zipper system 71 but without obstructing or covering main vertical zipper system 101, or even central zipper 65 when shell 17 is removed from body 15. Furthermore, one or both supplemental zipper systems 73 can be partially unzipped with the flap attachment 135 engaged, as shown in FIG. 4, to allow for localized front venting while shell 17 is otherwise still in place. Additionally, FIG. 2 shows at least a majority of the length of each supplemental zipper 73 is uncovered and exposed from outside the garment 11, and each supplemental zipper 73 extends along at least a majority of the corresponding sleeve segment substantially from an open and distal end 53 (see FIG. 3) of one of the sleeve segments to the collar 75. FIGS. 4 and 5 show jacket 11 in a user-standing orientation where the removable garment portion 17 has an upper diagonal edge corresponding to supplemental zipper 73, and a substantially vertical edge corresponding to main zipper 101, wherein the section of the removable garment portion defined by the upper edge and vertical edge is of a substantially triangular shape.

While various aspects of the present invention have been disclosed, it should be appreciated that variations may be made without departing from the scope of the present invention. For example, shell 17 may include a thermally insulative layer sewn to the inside thereof, containing polyester fiber batting, foam or goose down, for protection against cold weather; in this variation, a lightweight shell fabric (with less abrasion resistance) of about 70 denier would be used with insulation of about 70 to 200 grams. Furthermore, it is alternately envisioned that a fleece or other non-mesh, yet air permeable, material can be substituted in place of the mesh lower torso segment of body 15. Moreover, snap, hook and loop, interlocking barb, button and other disengagable fasteners can be employed instead of the preferred zippers and snaps, although some of the wind deterrent benefits of the present invention may not be realized. Shirts and other such garments may readily employ certain aspects of the present invention, although some of the advantages of the present invention may not be achieved. The preferred mesh ventilation material may solely be used on the sleeves, the torso, and/or localized portions thereof as long as an outer removable covering is provided, although again, some of the advantages of the present invention may not be fulfilled. Additional PVC or other waterproof coatings may be provided on any of the fabric layers to provide water resistance or waterproofing. It is also envisioned that the outer mesh material employed on the lower torso area of the body can be perforated with 1 millimeter by 4 millimeter long slits or cuts as long as ventilation is achieved. The present invention may alternately be used by bicycle riders, waist bags can be provided at the rear of the body for receiving the removed shell, and waterproof zippers can be provided in place of those disclosed herein. Furthermore, various materials have been disclosed in an exemplary fashion, but other materials may of course be employed, although some of the advantages of the present invention may not be realized. It is intended by the following claims to cover these and any other departures from the disclosed embodiments which fall within the true spirit of the invention.

The invention claimed is:

1. A garment comprising:

a substantially vertical main zipper located at a front torso region;

at least supplemental zipper located in a front and upper torso region, the supplemental zipper being angled between about 30°-150° relative to the vertical main zipper;

a collar, upper ends of the main and supplemental zippers being located adjacent the collar;

a flap attachment located on one torso side of the supplemental zipper; and a flap extending from the other side of the supplemental zipper, across the upper end of the supplemental zipper and disengagably attaching to the flap attachment but without covering the main zipper;

wherein a majority of the length of the supplemental zipper is uncovered and exposed from outside the garment.

2. The garment of claim 1 further comprising a garment body and a totally removable garment shell, the supplemental zipper operably coupling a portion of the shell to the body.

3. The garment of claim 2 wherein:

the body includes a wind resistant shoulder segment, a wind resistant upper sleeve segment, a ventilating torso segment and a ventilating sleeve segment; and the supplemental zipper separates the shoulder segment from the ventilating torso segment.

4. The garment of claim 1 further comprising a second supplemental zipper located in a front and upper torso region on the other side of the main zipper from the first supplemental zipper.

5. The garment of claim 1 further comprising a motorcycle garment body including the torso regions.

6. A motorcycle garment comprising:

a substantially vertical main zipper, when viewed in a user standing orientation;

at least one supplemental zipper angled between about 30°-150° relative to the vertical main zipper;

a neck opening, upper ends of the main and supplemental zippers being located adjacent the neck opening;

a garment body; and a totally removable garment portion including a lower torso segment, the supplemental zipper operably coupling a section of the garment portion to the body;

the removable garment portion having an upper diagonal edge corresponding to the supplemental zipper, and a substantially vertical edge corresponding to the main zipper, wherein the section of the removable garment portion defined by the upper edge and vertical edge is of a substantially triangular shape.

7. The motorcycle garment of claim 6 further comprising:

a flap attachment located on one side of the supplemental zipper; and a flap extending from the other side of the supplemental zipper, across the upper end of the supplemental zipper and disengagably attaching to the flap attachment but without covering the main zipper.

8. The motorcycle garment of claim 6 wherein the garment portion includes an outer garment shell.

9. The motorcycle garment of claim 6 further comprising a garment body including a wind resistant shoulder segment, wind resistant upper sleeve segment, a ventilating torso segment and a ventilating sleeve segment, the supplemental zipper separating at least a portion of the shoulder segment from at least a portion of the ventilating torso segment.

10. The motorcycle garment of claim 6 further comprising a body armor member coupled to a garment section.

11. The motorcycle garment of claim 6 further comprising a second supplemental zipper located on the other side of the main zipper from the first supplemental zipper, an end of the second supplemental zipper being located adjacent the neck opening.

12. The motorcycle garment of claim 6 further comprising a back zipper extending from a first sleeve end, up a first sleeve, across an upper back portion, down a second sleeve and terminating at a second sleeve end.

13. A garment comprising:

a substantially vertical main zipper located at a front torso region;

at least one supplemental zipper located in a front and upper torso region, the supplemental zipper being angled between about 30°-15° relative to the vertical main zipper;

a collar, upper ends of the main and supplemental zippers being located adjacent the collar;

a flap attachment located on one torso side of the supplemental zipper;

a flap extending from the other side of the supplemental zipper, across the upper end of the supplemental zipper and disengagably attaching to the flap attachment but without covering the main zipper;

a garment body and a totally removable garment shell, the supplemental zipper operably coupling a portion of the shell to the body; and body armor coupled to the body.

14. The garment of claim 13 wherein:

the body includes sleeves and a torso, and the body further includes a mesh-like section; and the shell is removably attachable to the body to deter air flow through the mesh-like section.

15. The garment of claim 13 wherein the supplemental zipper attaches an upper edge of the shell to the garment body, the second zipper extends substantially from an open and distal end area of a sleeve to the collar, and the garment is a motorcycle jacket.

16. The garment of claim 13 wherein the shell further includes a torso segment which externally covers at least a majority of a torso of the garment body when the shell and body are attached together, the shell including a wind resistant outer material and a substantially vertical front attachment system.

17. A garment comprising:

a substantially vertical main zipper located at a front torso region;

at least one supplemental zipper located in a front and upper torso region, the supplemental zipper being angled between about 3°-150° relative to the vertical main zipper;

a neck opening, upper ends of the main and supplemental zippers being located adjacent the neck opening; and a back zipper extending from adjacent a first sleeve end, up a first sleeve, across an upper back portion, down a second sleeve and terminating adjacent a second sleeve end.

18. The jacket of claim 17 further comprising an air permeable, mesh-like section of each of the sleeves located substantially continuously between an end area of the sleeve and an armpit area.

19. The jacket of claim 17 further comprising motorcycle body armor coupled to at least one of: a shoulder, a sleeve, and a back.

20. The garment of claim 17 further comprising an air permeable and mesh body segment, and an air resistant shell removably attached to cover the mesh body segment by at least the supplemental zipper and the back zipper.

21. The garment of claim 17 further comprising ultraviolet light blocking material permanently attached to a shoulder area of the garment and a mesh material permanently attached to the garment, the supplemental zipper and the back zipper being located substantially between the blocking material and the mesh material.

22. A motorsport jacket comprising:

sleeve segments each having a wind resistant section and an air permeable section permanently attached to the wind resistant section;

shoulder segments, the sleeve segments being permanently attached to the shoulder segments;

a torso segment permanently attached to at least one of the shoulder and sleeve segments;

a collar;

a wind resistant shell; and a zipper attaching at least a portion of the shell to at least one of the sleeve segments to block airflow through the air permeable section in at least one jacket configuration, the zipper extending along at least a majority of the corresponding sleeve segment substantially from an open and distal end of one of the sleeve segments to the collar.

23. The jacket of claim 22, wherein the torso segment includes at least one air permeable section and the shell blocks airflow through the air permeable section of the torso when the shell is attached.

24. The jacket of claim 22 wherein the wind resistant shell removably attaches to externally cover the torso segment.

25. The jacket of claim 22 wherein the wind resistant shell removably attaches to externally cover the air permeable section of the sleeve segments.

26. The jacket of claim 22 further comprising motorcycle body armor attached adjacent an elbow area, and at least a majority of the shoulder segments are wind resistant in all configurations of the jacket.

27. The jacket of claim 22 further comprising a perforated section of each of the sleeve segments located substantially continuously between an end area of the sleeve segments and an armpit area of the torso.

28. The jacket of claim 22 wherein the zipper fully extends to the open and distal end of one of the sleeve segments.

29. The jacket of claim 22 further comprising an elongated main front attachment system extending substantially from a waist area to the collar, the zipper being diagonally elongated relative to the main front attachment system.

30. A motorsport jacket comprising:

sleeve segments each having a wind resistant section and an air permeable section permanently attached to the wind resistant section;

shoulder segments, the sleeve segments being permanently attached to the shoulder segments;

a torso segment permanently attached to at least one of the shoulder and sleeve segments;

a neck opening;

a wind resistant shell;

a zipper attaching at least a portion of the shell to at least one of the sleeve segments to block airflow through the air permeable section in at least one jacket configuration, the zipper extending substantially from an end of one of the sleeve segments to the neck opening; and a second zipper attaching to another portion of the shell, the second zipper substantially continously extending from the end of one sleeve, across the back of the torso and to the end of the other sleeve.

31. The jacket of claim 30 wherein the torso includes a lower body segment above a waist area, and a majority of at least a front and back of the lower segment is air permeable.

32. A motorsport jacket comprising:

sleeve segments each having a wind resistant section and an air permeable section permanently attached to the wind resistant section;

shoulder segments, the sleeve segments being permanently attached to the shoulder segments;

a torso segment permanently attached to at least one of the shoulder and sleeve segments;

a neck opening;

a wind resistant shell; and a zipper attaching at least a portion of the shell to at least one of the sleeve segments to block airflow through the air permeable section in at least one jacket configuration, the zipper extending substantially from adjacent an end of one of the sleeve segments to the neck opening;

wherein a majority of front and back lower segments of the torso are air permeable when the shell is removed.

* * * * *

UNITED STATES PATENT AND TRADEMARK OFFICE

CERTIFICATE OF CORRECTION

PATENT NO. : 7,284,282 B2
APPLICATION NO. : 11/170934
DATED : October 23, 2007
INVENTOR(S) : Marc A. Bay It is certified that error appears in the above-identified patent and that said Letters Patent is hereby corrected as shown below:

Column 6, line 14, Claim 1, after “least”, insert --one--.

Column 7, line 28, Claim 13, “30°-15°” should be --30°-150°--.

Signed and Sealed this

Twenty-second Day of July, 2008

JON W. DUDAS
*Director of the United States Patent and Trademark Office*